US005445467A

United States Patent [19]

Peleman

[11] Patent Number: 5,445,467

[45] Date of Patent: Aug. 29, 1995

[54] BINDING FILE

[75] Inventor: Guido Peleman, Antwerpen, Belgium

[73] Assignee: Sisam SA, Lugano, Switzerland

[21] Appl. No.: 145,613

[22] Filed: Nov. 4, 1993

[30] Foreign Application Priority Data

Nov. 4, 1992 [BE] Belgium ..... 09200953
Dec. 2, 1992 [BE] Belgium ..... 09201054

[51] Int. Cl.[6] ..... B42F 3/06

[52] U.S. Cl. ..... 402/57; 402/73; 281/27.1

[58] Field of Search ..... 402/57, 19, 21, 31, 402/73; 281/37, 35, 2.9, 15.1, 21.1, 27.1

[56] References Cited

U.S. PATENT DOCUMENTS

| | | | |
|---|---|---|---|
| 671,041 | 4/1901 | Bailey | 281/29 |
| 2,112,389 | 3/1938 | Trussell . | |
| 2,142,816 | 1/1939 | Grumbacher | 281/29 |
| 2,155,576 | 4/1939 | Wolfson | 281/29 |
| 2,228,875 | 1/1941 | Grumbacher | 281/29 |
| 4,711,469 | 12/1987 | Bogar . | |
| 5,186,565 | 2/1993 | Jack | 281/15.1 |

FOREIGN PATENT DOCUMENTS

| | | | |
|---|---|---|---|
| 801751 | 8/1936 | France . | |
| 834090 | 11/1938 | France . | |
| 834827 | 12/1938 | France . | |
| 910287 | 1/1955 | Germany | 402/19 |
| 925772 | 3/1955 | Germany | 402/21 |
| 433363 | 4/1948 | Italy | 402/19 |
| 44995 | 1/1938 | Netherlands | 281/29 |
| 452123 | 8/1936 | United Kingdom | 402/57 |

*Primary Examiner*—David P. Bryant
*Attorney, Agent, or Firm*—Bacon & Thomas

[57] ABSTRACT

A binding file includes a front sheet, a rear sheet and a back. At the inside of the back, at only one edge of the back, the binding file includes a binding connection part having a free edge. This part is provided with one row of perforations which enables a binding element, incorporating ring-shaped closed binding rings, to be connected thereto so that sheets can be bundled interchangeably.

18 Claims, 3 Drawing Sheets

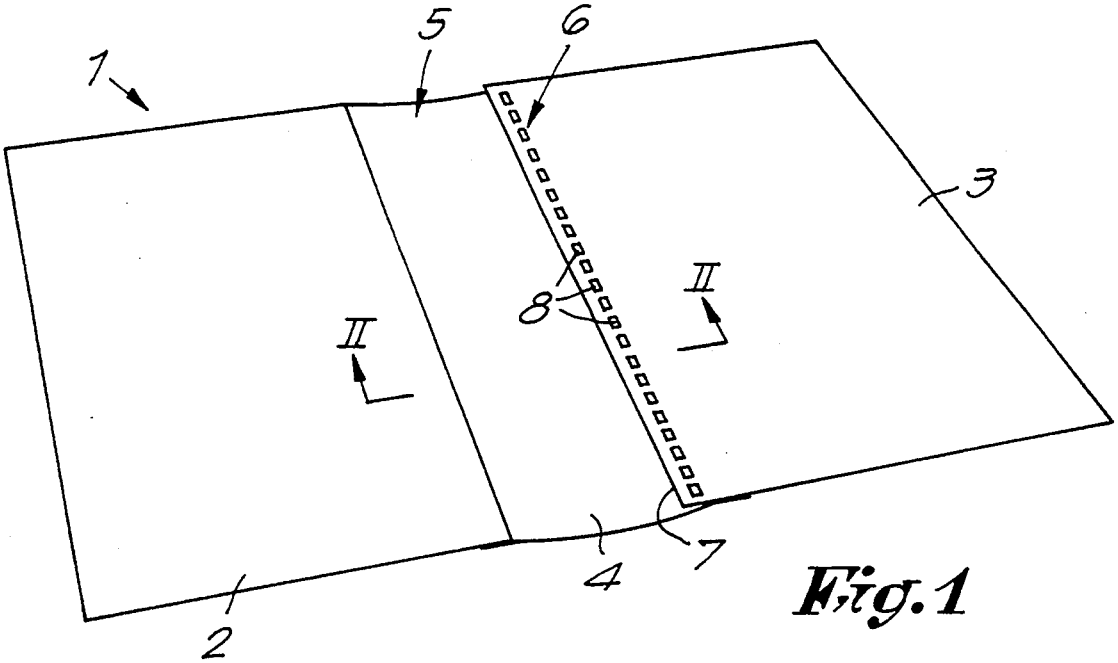
Fig. 1
Fig. 2
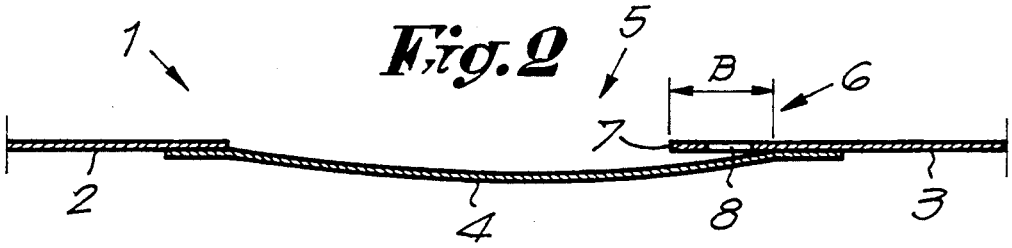
Fig. 5
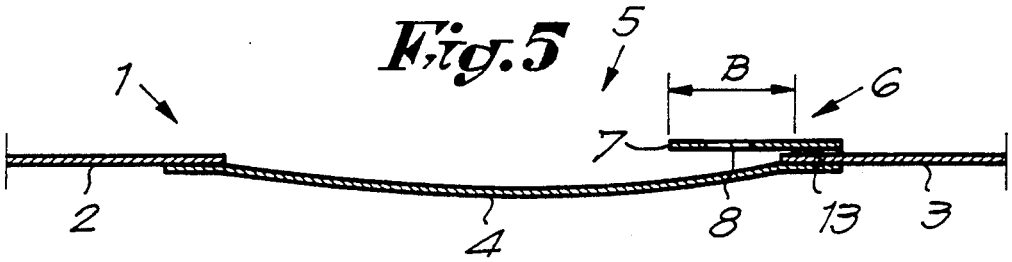
Fig. 6
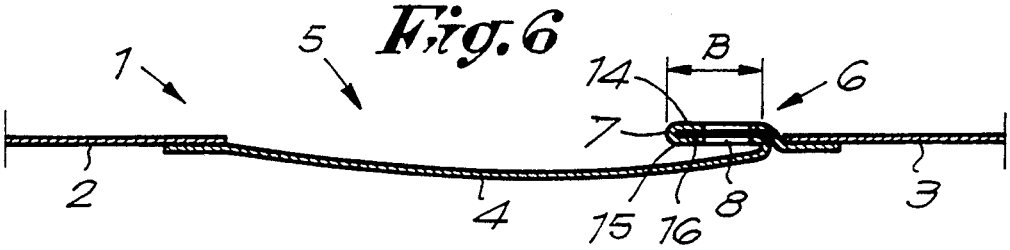

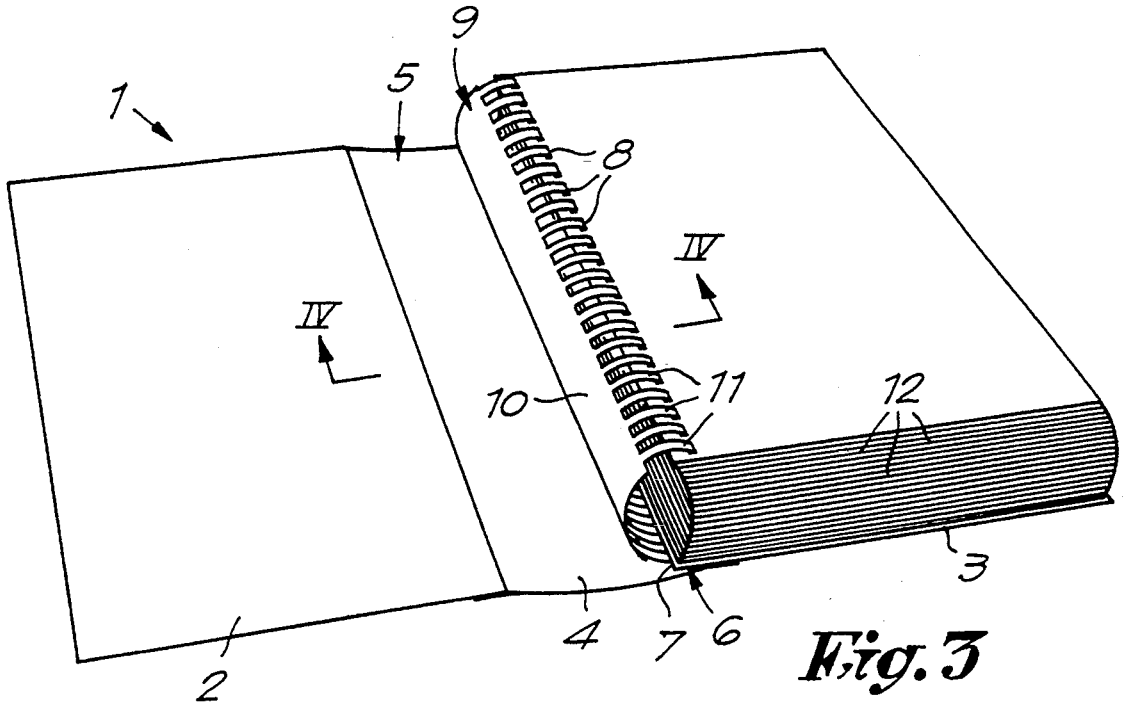
Fig. 3
Fig. 4
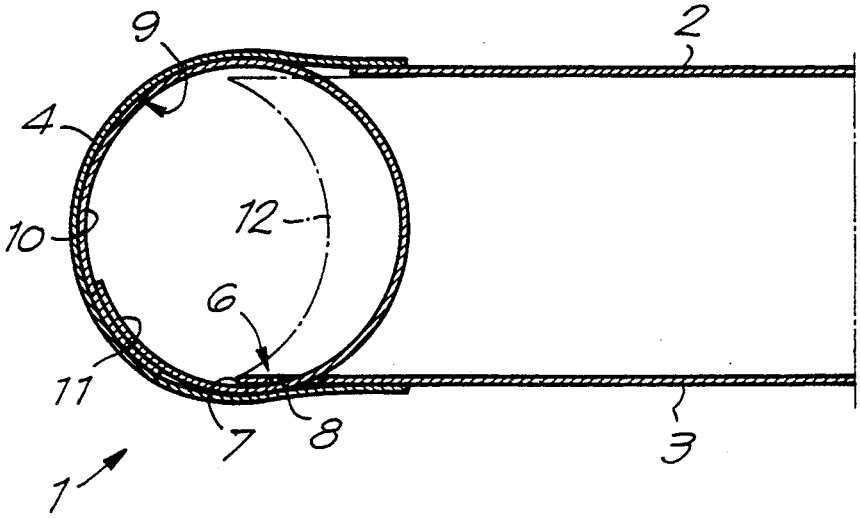

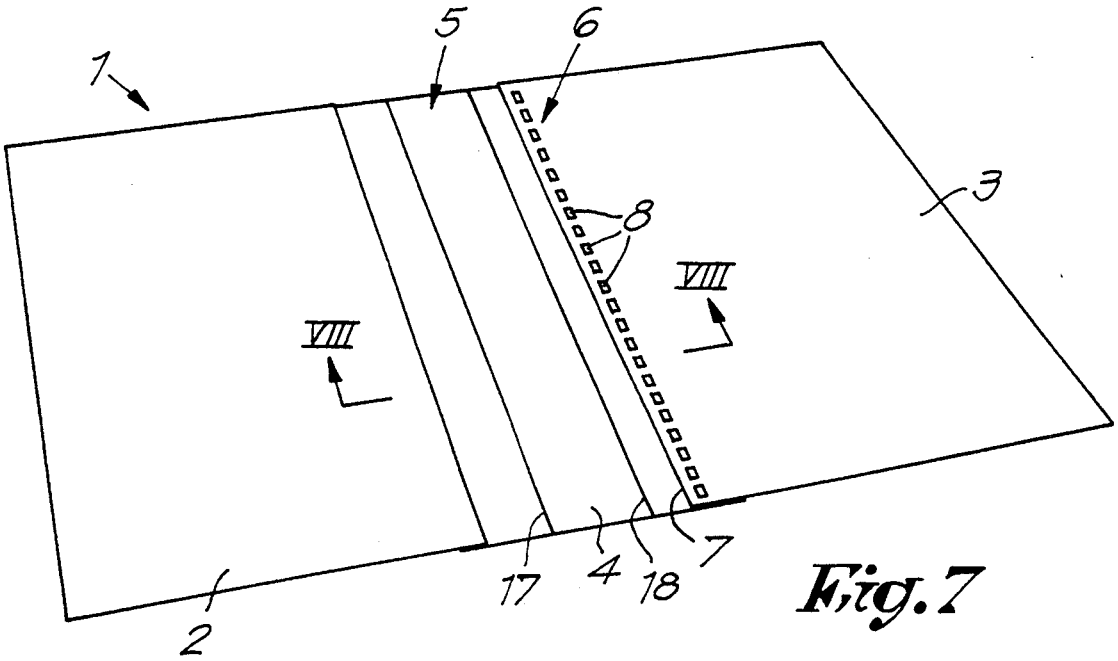
Fig. 7
Fig. 8
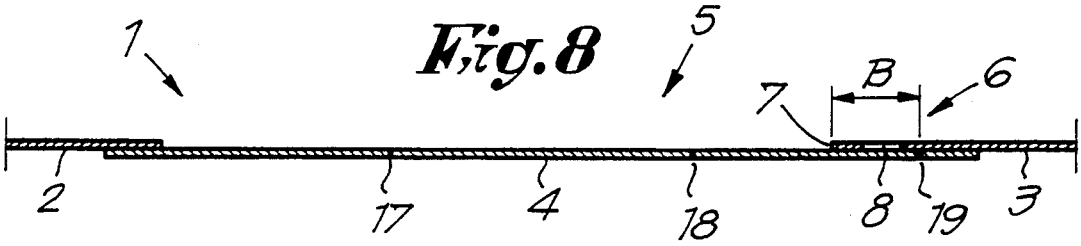
Fig. 9
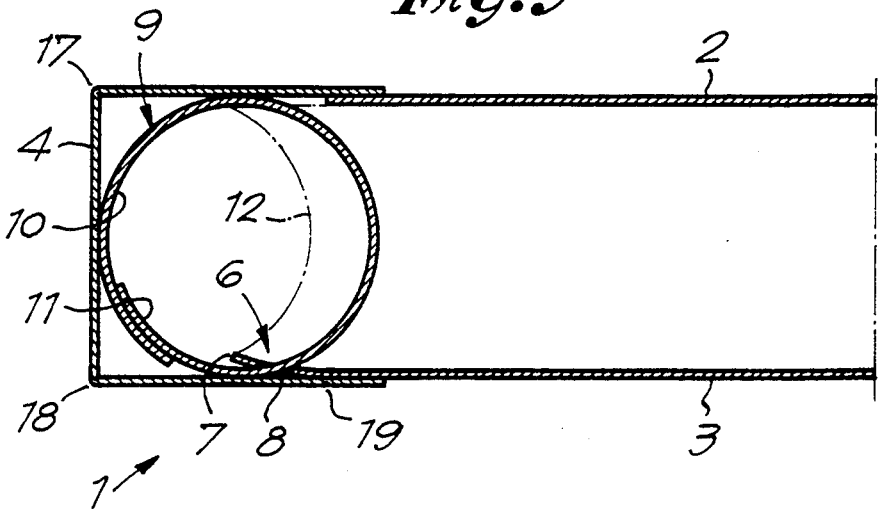

BINDING FILE

BACKGROUND OF THE INVENTION P This invention relates to a binding file, more specifically to a binding file for interchangeably bundling loose sheets.

It is known that, in order to interchangeably bundle sheets, use can be made of binding elements of the type consisting of a back and a number of teeth cooperating therewith. By pulling the teeth open, sheets which are provided with the necessary perforations, can be slid over the teeth, be removed therefrom respectively.

A disadvantage of such binding elements exists in that the bundles bound therewith cannot be placed nicely next to each other, and in that the teeth of the binding elements of bundles which are placed next to each other clench together.

Binding devices in which this disadvantage is excluded to a certain degree are known from the documents FR 834.090, FR 834.827, U.S. Pat. No. 4,711,469 and U.S. Pat. No. 2,112,389. However, the devices described herein present several disadvantages.

The devices described in FR 834.090 and FR 834.827 use open binding rings and are not suitable to apply binding elements with ring-shaped, for instance circular, closed binding rings.

The device described in U.S. Pat. No. 4,711,469 uses a binding file which consists of two separate parts. Applying such a binding file is complicated and removing sheets from or placing sheets in such file, without removing one of said parts, is nearly impossible.

U.S. Pat. No. 2,112,389 provides in a solution for a book, in other words a permanently bound whole, but does not offer a solution for a binding file allowing loose sheets to be bundled interchangeably.

SUMMARY OF THE INVENTION

The present invention relates to a binding file which excluded the above-mentioned disadvantages.

Moreover, the invention aims at a binding file which allows that the bundle bound by means of the binding element can be removed, or replaced respectively.

To this end, the invention relates to a binding file, consisting of a front sheet, a rear sheet and a back, characterized in that it is provided on the inside at the place of the back with a part with a free edge, whereby this part presents exactly one row of perforations allowing to connect a binding element with closed ring-shaped binding rings thereto, so that sheets can be bound interchangeably.

According to a first embodiment, the back of the binding file is made of a supple material, provided with folding lines or not. Said back can also be made of a stiff or relatively stiff material, which is in that case preferably provided with folding lines.

BRIEF DESCRIPTION OF THE DRAWINGS

In order to better show the characteristics of the invention, some preferred embodiments are described hereafter, as examples without any limitative character, reference being made to the accompanying drawings, in which:

FIG. 1 represents a binding file according to the invention;

FIG. 2 is an enlarged representation of a cross-section along line II—II in FIG. 1;

FIG. 3 represents the binding file of FIG. 1 during its use;

FIG. 4 is an enlarged representation of a cross-section along line IV—IV in FIG. 3, for the situation when the binding file is closed;

FIG. 5 and 6 represent analogous views as FIG. 2, but for two further embodiments;

FIG. 7 represents a variant of the binding file according to FIG. 1;

FIG. 8 is an enlarged representation of a cross-section along line VII—VII in FIG. 7;

FIG. 9 represents a cross-section similar to that of FIG. 4, but for the application of a file according to FIG. 7.

DETAILED DESCRIPTION OF THE PREFERRED EMBODIMENTS

As represented in FIGS. 1 and 2, the binding file 1 according to the invention consists of a front sheet 2, a rear sheet 3 and a back 4. The particularity of the invention exists in that this binding file 1 is provided, on its inside 5 at only one edge of the back 4, with a part 6 with a free edge 7, whereby this part 6 at the free edge 7 presents exactly one row of perforations 8 which allow a binding element 9 with ring-shaped closed binding rings to be connected thereto.

As represented in FIGS. 3 and 4, the perforations 8 are conceived in such a way that a binding element 9 can be connected thereto, in such a way that this binding element 9 is located at the place of the back 4.

The binding element 9 consists as is known of a back portion 10 which is provided with elastically bendable teeth 11, forming ring-shaped closed binding rings. Due to the bending of the teeth 11, perforated sheets 12 can be connected to the binding element 9. In an analogous way, the binding element 9 can be applied in the binding file 1, together with the bundled sheets 12.

As represented in FIGS. 1 and 2, part 6 preferably consists of an extending flap or flange in the shape of a strip which is connected to the file opposite the edge 7, or forms one whole with the file.

In order to obtain that the bundle of sheets 12 is not loosely in the file, the width B of the free edge of the part 6 is preferably kept as small as possible. In the preferred embodiment, the width B is less than 1 cm. More specifically, it is preferred that the perforations 8 are located immediately next to the transition between the part 6 and the actual file.

As represented in the embodiment of FIGS. 1 and 2, the front sheet 2, the rear sheet 3 and the back 4 can consist of separate parts which are connected to each other, for instance welded or glued together. In this embodiment, the back 4 is preferably more supple than the front sheet 2 and the rear sheet 3.

As further represented in FIGS. 1 and 2, the rear sheet 3 and part 6 can be made of one single sheet. The part 6 is hereby formed by connecting the back 4 to rear sheet at a distance B of the extremity 7. This method of composing offers the advantage that no separate parts 6 need to be manufactured and connected.

As represented in FIG. 5, the part 6 can also consist of a strip which is connected to the inside of the binding file 1. The connection can be of any kind. As represented in FIG. 5 use can be made of glue 13.

Some other possibilities consist in that the part 6 is connected to the binding file 1 by means of double-sided adhesive tape, that the part 6 is welded to the binding file 1, or that a connection by mechanical means, such as staples, is provided.

In FIG. 6 a variant is represented whereby the part 6 is formed from a doubled part of the binding file 1, whereby the doubled parts 14 and 15 are preferably connected to each other, for instance by means of glue 16 or according to one of the above-mentioned connection methods.

Part 6 can be located at the front sheet 2, the rear sheet 3 as well as at the back 4. In the above-mentioned examples of FIGS. 2 and 5, the part 6 is connected to the rear sheet 3. In the above-mentioned example of FIG. 6, this part 6 forms part of the back 4.

The part 6 is preferably made of a relatively stiff material. This offers the advantage that the binding element 9 can move little or not at all in the binding file 1.

All composing parts can be made of synthetic material, for instance PVC. The fact that the part 6 is made of synthetic material offers the advantage that the perforations will not easily tear.

It is clear that the invention relates to binding files 1 which are provided with a binding element 9 or not.

In FIGS. 7 to 9 a variant is described which only differs from the above-described embodiments in that the back 4, which is made of a supple, relatively stiff or stiff material, is provided with at least two folding lines 17–18, which allow that, after the binding, a flat back portion is obtained so that the insertion of annotations is made easier.

In the case of a stiff material, another folding line 19 will preferably be provided, in order to facilitate the application of the binding element 9. The folding line 19 is located at such a place that the back 4 can easily be moved away from the part 6, so preferably on the end of the back. Such folding line 19 can be applied in each of the above-described embodiments.

The folding lines can be obtained in any manner such as by applying impressions, by providing weakened lines, etc.

The present invention is in no way limited to the embodiments described as examples and represented in the drawings, but such binding file can be realized in different shapes and dimensions without leaving the scope of the invention.

I claim:

1. A binding file comprising:

a front sheet;

a rear sheet;

a back having opposed, longitudinally extending edge portions attached to said front and rear sheets respectively;

a single binding connection part provided at one of said opposed edge portions of said back, said binding connection part including a free end that extends longitudinally between said front and rear sheets, said binding connection part being provided with a row of longitudinally spaced perforations adjacent said free end; and a binding element, upon which it plurality of sheets can be bundled interchangeably including a plurality of longitudinally spaced, ring-shaped closed binding rings, each of said binding rings being attached to one of said front sheet, rear sheet and back of said binding file solely by each of said binding rings extending through a respective one of said perforations.

2. A binding file according to claim 1, wherein the back is made of a supple material.

3. A binding file according to claim 2, wherein said binding connection part integrally formed with one of said front and rear sheets.

4. A binding file according to claim 2, wherein said binding connection part directly attached to said back.

5. A binding file according to claim 1, wherein the back is made of a stiff material.

6. A binding file according to claim 5, wherein the back is provided with folding lines.

7. A binding file according to claim 1, wherein said row of perforations is located immediately adjacent to said back.

8. A binding file according to claim 1, wherein the rear sheet and the back comprise separate elements, and said binding connection part and the rear sheet are integrally formed.

9. A binding file according to claim 1, wherein said binding connection part is directly attached to one of said front and rear sheets.

10. A binding file according to claim 1, wherein said binding connection part is integrally formed with one of said front and rear sheets.

11. A binding file according to claim 1, wherein said binding connection part is directly attached to said back.

12. A binding file according to claim 1, wherein said binding connection part is integrally formed with said back.

13. A binding file according to claim 1, wherein said binding connection part comprises a portion of one of said front sheet, said rear sheet and said back that has been doubled over itself and connected together.

14. A binding file according to claim 13, wherein said binding connection part IS directly attached to one of said front and rear sheets.

15. A binding file according to claim 13, wherein said binding connection part IS integrally formed with said back.

16. A binding file according to claim 1, wherein said binding connection part IS made of a stiff material.

17. A binding file according to claim 1, wherein said binding connection part IS made of synthetic material.

18. A binding file according to claim 1, wherein the back is provided, at said one of said opposed edge portions thereof, with a folding line in order to facilitate the insertion of said binding element into said binding file.

* * * * *